US005683266A

United States Patent [19]

Guidi et al.

[11] Patent Number: 5,683,266

[45] Date of Patent: Nov. 4, 1997

[54] DEVICE AND METHOD FOR THE MECHNICAL AND ELECTRICAL CONNECTION OF A TERMINAL

[75] Inventors: Guido Guidi, Frosinone; Giampaolo Boezi; Luigi Reibaldi, both of Alatri, all of Italy

[73] Assignee: Bitron S.p.A., Cantalupa, Italy

[21] Appl. No.: 413,967

[22] Filed: Mar. 30, 1995

[30] Foreign Application Priority Data

Mar. 31, 1994 [IT] Italy ..... TO94A1242

[51] Int. Cl.[6] ..... H01R 4/24

[52] U.S. Cl. ..... 439/395

[58] Field of Search ..... 439/395, 397, 439/592, 849, 400, 402, 405, 443, 874

[56] References Cited

U.S. PATENT DOCUMENTS

| | | | |
|---|---|---|---|
| 2,316,555 | 4/1943 | Bugg | 439/592 |
| 3,546,633 | 12/1970 | Holmberg, Jr. | 439/849 |
| 3,979,615 | 9/1976 | Neff | 439/443 |
| 4,256,360 | 3/1981 | Debaigt | 439/400 |
| 4,593,963 | 6/1986 | Endo et al. | 439/397 |
| 4,648,673 | 3/1987 | Endo et al. | 439/395 |
| 5,167,545 | 12/1992 | O'Brien et al. | 439/874 |

FOREIGN PATENT DOCUMENTS

| | | |
|---|---|---|
| 0320323 | 6/1989 | European Pat. Off. . |
| 0501392 | 9/1992 | European Pat. Off. . |
| 7821715 | 11/1978 | Germany . |
| 3438800 | 5/1985 | Germany . |

OTHER PUBLICATIONS

Suel Shannon, Wire to Board Terminal, Oct. 1980, Whole Document.

*Primary Examiner*—Khiem Nguyen
*Assistant Examiner*—Yong Ki Kim
*Attorney, Agent, or Firm*—Levine & Mandelbaum

[57] ABSTRACT

A device is described, for the connection, both mechanical and electrical, of a terminal of electric and/or electronic components. The device has a contact element which is permanently elastic, made of a foil of electrically conductive material, said contact element including an insertion zone for the terminal defined by two opposite hemisurfaces, and a flexion slot of the two hemisurfaces, contiguous to the contact zone, for allowing the insertion of the terminal in a stressed condition of the hemisurfaces within the limits of elasticity of the material constituting the foil.

4 Claims, 2 Drawing Sheets

DEVICE AND METHOD FOR THE MECHNICAL AND ELECTRICAL CONNECTION OF A TERMINAL

FIELD OF THE INVENTION

The present invention relates to a device and a method for the connection and the electric contact of terminals of electric and/or electronic components.

BACKGROUND OF THE INVENTION

It is known that for achieving the permanent connection and contact of terminals of electric and/or electronic components, such as for example, resistor rheophores or leads, or connecting terminals of coils or relays, it has become common practice to utilize welding, in its different available techniques (tin, laser, supersonic, etc.).

For achieving permanent contacts, there are also known holding systems which provide a contact interface having shear-shaped elements, able to retain the aforementioned terminals in a plastic or resilient way: such known devices are therefore characterized by a notable plasticity or resilience, inasmuch as the cited shear-shaped elements, apart from achieving electric contact, have to be able to block the terminal in a permanent way (for the definitions of plasticity, elasticity, limits of elasticity, plastic field of materials, and the relevant governing laws, any engineering text can be consulted).

Such known devices for holding and contacting are usually provided for working on the limit condition of the plastic field of the material which constitute them, whereupon they often suffer drawbacks in particular working conditions. For example, in the case of vibrations and/or thermal shock, the electric contact between terminal and interfaces is subject to temporary interruptions caused by the imperfect electric union of the parts; said imperfect union is due to the fact that the interface-terminal junction happens in a stressed condition that can overcome the limit of the plastic field of the materials; this involves therefore the possibility of failure of the system in which the device is used, especially if a functional constraint of permanent electric junction is required.

The cited problem is exacerbated by mechanical working tolerances, which can determine a dispersion of the pressure characteristics with which the junction between interface and terminal occurs.

In some known devices, the contact interface is subject to one or more superficial coinings, i.e., swaging operations, the condition of high plasticity of the interface being the same: such solutions, however, do not allow for the complete elimination of the cited drawbacks.

Another problem of the prior art is then represented by the fact that, due to the particular geometry necessary for assuring holding, the coupling phase between terminals and known holding devices requires attention to details, which makes the manufacturing process complicated.

From the above, it therefore follows that the realization of the known holding and contact devices requires geometry which is complicated, materials that are very ductile, or plastic, and manufacturing which is somewhat complicated without, however, assurance of high reliability.

OBJECT OF THE INVENTION

The aim of the present invention is that of eliminating the cited drawbacks of the known art, and in particular to provide a device for the connection of a terminal of electric and/or electronic components which, working within the full limits of elasticity, allows the absorption of any eventual deformation, owing for example, to vibrations and/or thermal shocks.

A further aim of the present invention is that of providing a device which can be simple and economically produced, which is characterized by continuity of the electric contact between the joined parts, and which allows, therefore, for increased reliability of the contact under various different conditions of use.

SUMMARY OF THE INVENTION

Said aims are attained according to the present invention through a device for the connection, both mechanical and electrical, of a terminal of electric and/or electronic components, which provides a contact element that is permanently elastic, and made of a foil of an electrically conductive material, said contact element including an insertion zone for the terminal defined by two opposite hemisurfaces, and a flexion slot of the two hemisurfaces contiguous to the contact zone, that is able to allow the insertion of the terminal in a stressed condition of the hemisurfaces within the limits of elasticity of the material constituting the foil.

Said aims are equally attained by a method for the permanent connection, both mechanical and electrical, of a terminal to a contact device, wherein said contact device is obtained starting from a foil or an electrically conductive material, whereby the following steps are provided:

in the foil there are present:

A) a contact zone defined by two opposite hemisurfaces, a diameter of the terminal being greater than the distance between the hemisurfaces;

B) two slant planes; being opposite and converging from an end of the foil towards the hemisurfaces;

C) a flexion slot; being contiguous to the contact zone and dimensioned so as to allow a stress of the foil being comprised within the limits of elasticity of the material constituting the foil;

the terminal is inserted in the notch defined by the slant planes, so as to be downwardly guided for resting on the upper zone of the hemisurfaces;

the notch is stressed within the full limits of elasticity of the material constituting the foil, by means of a suitable tool, which serves to slightly widen the hemisurfaces, thereby allowing the terminal to enter in the holding and contact zone defined by the same hemisurfaces;

the tool is moved backward and the terminal remains rigidly coupled between the hemisurfaces.

BRIEF DESCRIPTION OF THE DRAWINGS

Further characteristics and advantages of the present invention will result in being clear from the detailed description which follows, carried out with reference to the annexed drawings, being supplied purely as an explanatory and non-limiting example, wherein.

DESCRIPTION OF THE PREFERRED EMBODIMENT

Figure 1:
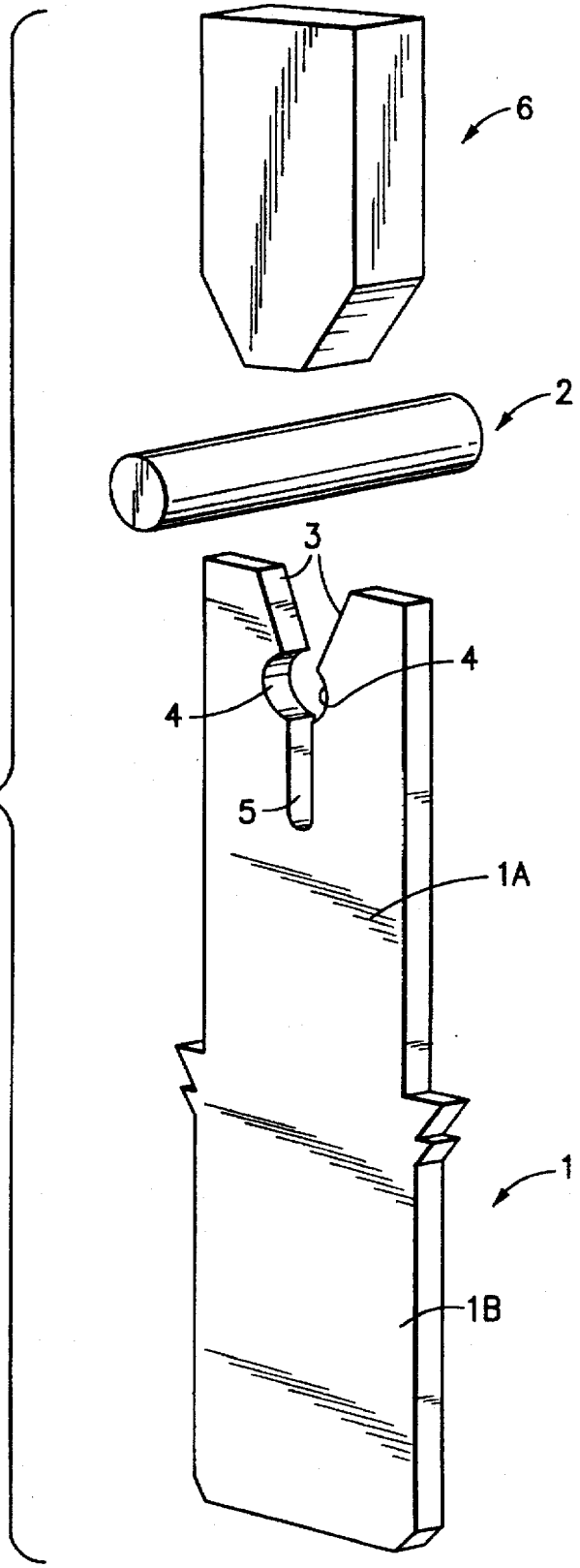
in FIG. 1 a contact interface of the device according to the present invention is represented in perspective view.

In the cited figures, reference number 1 indicates the holding and contact device according to the present invention, composed in the shown case by a small foil of normal brass, for example of the type 67 H10 or 67 H20, duly shaped; in the shown case, such a device 1 is practically constituted by classic terminal of the "Faston"™ type electrical connector, for example of the type of those used in relays for motor vehicles: in particular, in the case of FIG. 1, with 1A refers to an interfacing zone, or contact interface, while with 1B refers to the more properly said "Faston" electrical connector portion, i.e., a portion for the connection of the device 1 to another interlocked device.

With reference number 2 a contact element is shown, which has to be coupled to the interface 1A, i.e., the terminal of an electric and/or electronic component. For example, the element 2 may be the rheophore or conductive lead of a resistor, or the terminal of a coil for relays. For exemplification purposes, the contact element 2 has been represented in the figures as having a round cross section, although it is possible to adapt the device for other shapes.

With reference number 3 two opposite planes are indicated, being slant, in the illustrated case of 60° one to the other, that converge from the top of the interface 1A up to two contact hemisurfaces 4; said hemisurfaces 4, which in the illustrated specific case have a curved shaped, realize the "heart" of the interface 1A, or a contact zone for containing the element or terminal 2 in the permanent working position.

The shape of the hemisurfaces 4 depends upon the cross section of the contact element or terminal 2 to be used in conjunction with the interface 1A. So too is the diameter delimited by the hemisurfaces 4, that is, it is slightly less than the diameter of the contact element or terminal 2.

The two slant planes 3 have the function of facilitating the positioning and the insertion of the contact element 2 within the hemisurfaces 4, and the function of facilitating the elastic deformation being necessary for the right positioning of the two parts in contact.

Reference number 5 indicates a flexion slot, obtained in the interface 1A under the area defined by the contact hemisurfaces 4. The slot 5, even if the device of the invention is not of the type having prevalent elastic holding properties still provides the minimum elasticity that allows the insertion of the contact element 2 between the hemisurfaces 4 in a stressed condition of the interface 1A.

Reference number 6 finally indicates a suitable tool, making up part of a machine suitably equipped, provided for carrying out the elastic deformation of the interface 1A, by means of the widening of the slant planes 4. In the illustrated case, the tool 6 has in fact a trapezoidal profile with a attack angle of 75°, i.e., has a dimension greater that the angle of 60° defined by the two slant planes 3.

From the above it can be understood that, in substance, the device of the invention is realized through a foil in an electrically conductive material in which are present;

a holding and contact zone defined by two hemisurfaces 4, a flexion slot 5 for the two contact hemisurfaces 4, contiguous to the holding and contact zone, that allows the insertion of the terminal 2 in a stressed condition of the holding zone being comprised within the limits of elasticity of the material that constitutes the foil;

two slant planes 3 converging towards the hemisurfaces 4, having the aim of guiding the terminal 2 towards the holding and contact zone.

The operation of the device according to the invention is as follows.

The contact element or terminal 2 is inserted in the notch defined by the slant planes 3, so as to be guided downwardly for resting on the upper zone of the hemisurfaces 4 (as mentioned, the diameter A is less than the diameter of 2); successively, such a notch is resiliently deformed due to the action of the tool 6, which pushes down with a predetermined force, for example in the order of 10 Newton, and for a determined stroke, for example under the control of a suitable force transducer. Such a lowering of the tool 6 has the effect of slightly widening the hemisurfaces 4, allowing the element 2 to penetrate between the same hemisurfaces. The cited operation is carried out within the full limits of elasticity of the material constituting the interface 1A. Due to the presence of the flexion slot 5, which is specifically dimensioned for a desired range, seating of the contact element 2 is achieved in the permanent contact zone defined by the two hemisurfaces 4.

Once such a positioning is obtained, the tool 6 is raised and the contact element 2 remains rigidly coupled between the hemisurfaces 4, in a state of elastic stress.

Figure 2:
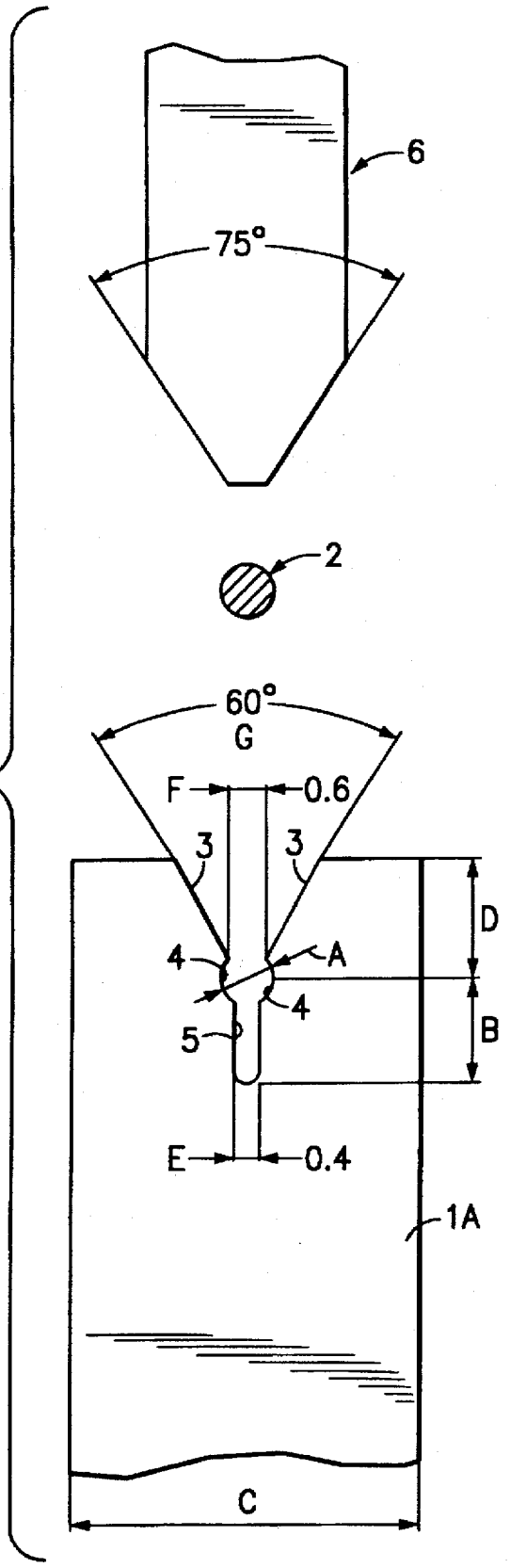
in FIG. 2 the contact device according to the present invention is represented in schematic front view.

It is apparent that the correct dimensioning and the cooperative arrangement of the slot 5, the hemisurfaces 4 and the slant planes 3 are determined depending upon the case, the basic concept of the invention remaining the same, i.e., that of allowing the insertion of the terminal 2 in a stressed condition of the hemisurfaces within the limits of elasticity of the material constituting the interface 1A; the parameters A–G of FIG. 2 are, in other words, duly calculated during the project phase, depending upon the use of the device and the type of terminals to retain and connect.

An example of the constructive parameters of the device and of the coupling method which are the objects of the present invention, in the case of a rheophore or conductor 2 of tinned annealed copper (or soft-copper) having a diameter of 0.8 mm, and an interface 1A realized starting from a foil of brass of the type 67 H10 being 0.8 mm thick, follows (with reference to the dimension arrows of FIG. 2):

A=0.75 mm
B=1.175 mm
C=3.75 mm
D=1.575 mm
E=0.40 mm
F=0.60 mm
G=60°

In the just exemplified case, the attack angle of the tool 6 is 75° and the force necessary for producing the desired flexion within the full limits of elasticity of the device 10 Newtons.

In respect of the prior art, the main advantage of the described device is due to the fact that, according to invention, it is possible to obtain coupling and permanent electric contact by using materials having a high electric conductivity, even though they do not normally have a "spring" function, such as, for example, common brass of type 67 H10 or 67 H20. On the contrary, as mentioned in the opening of the present description, known devices require constructive materials which are highly plastic or resilient, inasmuch as such known devices base their functioning just upon the plasticity or resilience of the material. As mentioned, however, this is a source of drawbacks.

Therefore, in comparison to the prior art, with the present invention only a minimum elasticity is required for allowing initial coupling between the interfaces 1A and the contact element 2. Rigid coupling is then realized by means of the hemisurfaces 4.

As mentioned, by means of an adequate dimensioning of the parameters of the parts of the interface 1A, it is possible to generate the desired condition of electric contact, so as to satisfy functional needs which, up to now, required welding systems.

Concerning the manufacturing process, as mentioned the device 1 can be obtained starting from a foil of electrically conductive material, advantageously punched for realizing the slant planes 3, the hemisurfaces 4 and the slot 5. In the case in which the slot 5 must have a reduced width E, which could make the punching process problematic or impossible, it is possible to proceed in one of following ways:

A) to use a starting foil having reduced thickness, which allows punching operations for obtaining the slot 5 on the portion 1A; and to then fold up the opposite portion 1B of the starting foil, for obtaining the Faston electrical connector zone having the thickness adequate to the needs, or B) to use a starting foil of adequate thickness for the connection to be realized through the portion 1B, and to subject a portion of the foil to a reduction of cross section, or coining (i.e., a squeezing or swaging), for bringing its thickness to a dimension which allows for punching the slot 5 of desired width; and to use the remaining portion 1B of the foil for connection of the device 1 with another interlocked device.

It can then be seen that coupling between the contact element 2 and the interface 1A may be realized in an automatic way, but without the particular complexities characterizing the prior art.

From the given description, the characteristics of the present invention are thus clear, as are its advantages. In particular, the possibility of realizing holding and permanent contact devices by means of common materials with high electric conductivity, the simplicity or realization due to the elementary geometry, and the manufacturing simplicity inasmuch as the terminal-device coupling phase does not require particular attention to details should be underscored.

It is clear that several variant embodiments and applications are possible for the device which is the object of the present invention.

For example the device of the invention may be used with a terminal 2 on which tin is present as a protective galvanic coating. In such a case, after the execution of the coupling operation as described above, a remelting phase of the tin may be provided, being obtainable in a very simple way, for example by means of a heating element; in this way it is therefore possible to obtain interaction between electric conduction due to the remelting of the tin and electric conduction obtained by the contact pressure between the parts as described above, with a further increase in the functional reliability of the same device. Such an application is particularly indicated for heavy conditions of use, including, for example, connection of the ends of the coil of a relay, or other similar devices, where the connection is critical.

It is then evident that, as already mentioned, upon changing the cross section of the contact element or terminal 2, the hemisurfaces 4 should also have a corresponding shape different in respect of the semicircular one, herein described as an example.

It is however clear that several other changes can be made to the device being the object of the present invention, without departing from the novelty principles inherent the inventive idea.

What is claimed is:

1. A holding and contact device for mechanically and electrically connecting a bare terminal of an electrical component to a device, comprising a substrate made of an electrically conductive material, said substrate having two prongs defining therebetween a slot for receiving the terminal, said slot having an open end at an end of said substrate and a closed end within said substrate, said prongs comprising respective inlet tapering edges having first ends proximate said open end of said slot and second ends distal from said open end of said slot, said inlet tapering edges converging inwardly toward one another from said first ends toward said second ends for defining an inlet portion of said slot, respective intermediate facing arcuate edges intersected by said inlet tapering edges and having first ends coextensive with the second ends of said inlet edges and second ends distal from the second ends of said inlet edges, and respective straight edges extending from the second ends of said intermediate arcuate edges and defining a flexion portion of said device extending to the closed end of said slot, said slot having at the intersection of said inlet tapering edges with said intermediate arcuate edges a restricted passage the width of which is less than the width of the bare terminal and greater than the width of the slot in the flexion portion, and a tool insertable between said prongs for elastically deforming them to widen said slot.

2. A device according to claim 1, wherein said tool has two tapering edges forming an angle greater than an angle between said tapering edges.

3. A method of mechanically and electrically connecting a terminal to a device comprising forming in a substrate of conductive material two prongs defining therebetween a slot for receiving the terminal, said slot having an open end at an end of said substrate and a closed end within said substrate, said prongs comprising respective inlet tapering edges having first ends proximate said open end of said slot and second ends distal from said open end of said slot, said inlet tapering edges converging inwardly toward one another from said first ends toward said second ends for defining an inlet portion of said slot, a contact zone between respective intermediate facing arcuate edges intersected by said inlet tapering edges and having first ends coextensive with the second ends of said inlet edges and second ends distal from the second ends of said inlet edges, and respective straight edges extending from the second ends of said intermediate arcuate edges and defining a flexion portion of said device extending to the closed end of said slot, said slot having at the intersection of said inlet tapering edges with said intermediate arcuate portions a restricted passage the width of which is less than the width of the bare terminal and greater than the width of the slot along the flexion portion inserting the terminal in the notch defined by the tapering edges so as to be inwardly guided toward the contact zone;

inserting a tool into the inlet portion of the slot against said tapering edges for separating the prongs within the limits of elasticity of the material to slightly widen the contact zone thereby allowing the terminal to enter the contact zone; and withdrawing the tool thereby leaving the terminal secured between the arcuate edges.

4. A method according to claim 3, further comprising melting a coating material present on said terminal in order to enhance the mechanical and electrical connection.

* * * * *